US010619924B2

(12) United States Patent
Ylimäinen

(10) Patent No.: US 10,619,924 B2
(45) Date of Patent: Apr. 14, 2020

(54) METHOD FOR CONTROLLING A METAL STRIP IN A HEAT TREATMENT FURNACE

(75) Inventor: Hannu Ylimäinen, Tornio (FI)

(73) Assignee: OUTOKUMPU OYJ, Espoo (FI)

( * ) Notice: Subject to any disclaimer, the term of this patent is extended or adjusted under 35 U.S.C. 154(b) by 0 days.

(21) Appl. No.: 12/301,262

(22) PCT Filed: May 29, 2007

(86) PCT No.: PCT/FI2007/000144

§ 371 (c)(1),
(2), (4) Date: Nov. 18, 2008

(87) PCT Pub. No.: WO2007/138152

PCT Pub. Date: Dec. 6, 2007

(65) Prior Publication Data

US 2009/0229712 A1 Sep. 17, 2009

(30) Foreign Application Priority Data

Jun. 1, 2006 (FI) ..... 20060536

(51) Int. Cl.
*F27B 9/28* (2006.01)
*C21D 9/63* (2006.01)
(Continued)

(52) U.S. Cl.
CPC ..... *F27B 9/28* (2013.01); *C21D 9/573* (2013.01); *C21D 9/63* (2013.01); *C21D 11/00* (2013.01);
(Continued)

(58) Field of Classification Search
CPC ..... F27B 9/28; F27B 9/40; F27B 9/12; F27B 9/20; F27D 19/00; F27D 21/00; C21D 11/00; C21D 9/573; C21D 9/63
(Continued)

(56) References Cited

U.S. PATENT DOCUMENTS 5,616,295 A * 4/1997 Tawara ..... C21D 9/63 266/103
6,895,692 B2 5/2005 Kramer
2005/0158685 A1* 7/2005 Murakami et al. ..... 432/128

FOREIGN PATENT DOCUMENTS

EP 0202023 11/1986
JP S5547326 A 4/1980
(Continued)

OTHER PUBLICATIONS

Machine Translation of JP H0261011 to Kawasaki Steel Co. (Year: 1990).*

(Continued)

*Primary Examiner* — Daniel C. McCracken

(74) *Attorney, Agent, or Firm* — Robert P. Michal, Esq.; Carter, DeLuca & Farrell LLP

(57) ABSTRACT

The invention relates to a method for controlling a metal strip to be heat-treated, contained in a continuously operated heat treatment furnace and proceeding in an essentially horizontal direction and suspended position in a zone arranged between elements meant for supporting the metal strip when said metal strip is being cooled. The trajectory of the metal strip is measured by a measuring device, and on the basis of the obtained measurement results, the metal strip is subjected to a controlled cooling agent jet, so that the trajectory of the metal strip, at least in the zone located between the elements meant for supporting the metal strip, is made to proceed in between devices installed around the trajectory and meant for conveying the cooling agent.

2 Claims, 1 Drawing Sheet

(51) Int. Cl.

| | |
|---|---|
| ***C21D 9/573*** | (2006.01) |
| ***C21D 11/00*** | (2006.01) |
| ***F27D 21/00*** | (2006.01) |
| ***F27B 9/20*** | (2006.01) |
| ***F27D 19/00*** | (2006.01) |
| ***F27B 9/12*** | (2006.01) |
| ***F27B 9/40*** | (2006.01) |

(52) U.S. Cl.
CPC ..... *F27B 9/12* (2013.01); *F27B 9/20* (2013.01); *F27B 9/40* (2013.01); *F27D 19/00* (2013.01); *F27D 21/00* (2013.01)

(58) Field of Classification Search
USPC ..... 148/508; 34/621
See application file for complete search history.

(56) References Cited

FOREIGN PATENT DOCUMENTS

| | | | | | |
|---|---|---|---|---|---|
| JP | 62004833 | | | 1/1987 | |
| JP | H0261011 | A | | 3/1990 | |
| JP | 06002051 | A | * | 1/1994 | ..... C21D 11/00 |
| JP | 7011336 | | | 1/1995 | |
| JP | 2001049354 | | | 2/2001 | |

OTHER PUBLICATIONS

Extended European Search Report prepared by the European Patent Office for EP 2021517, dated Mar. 23, 2012, 6 pages.

* cited by examiner

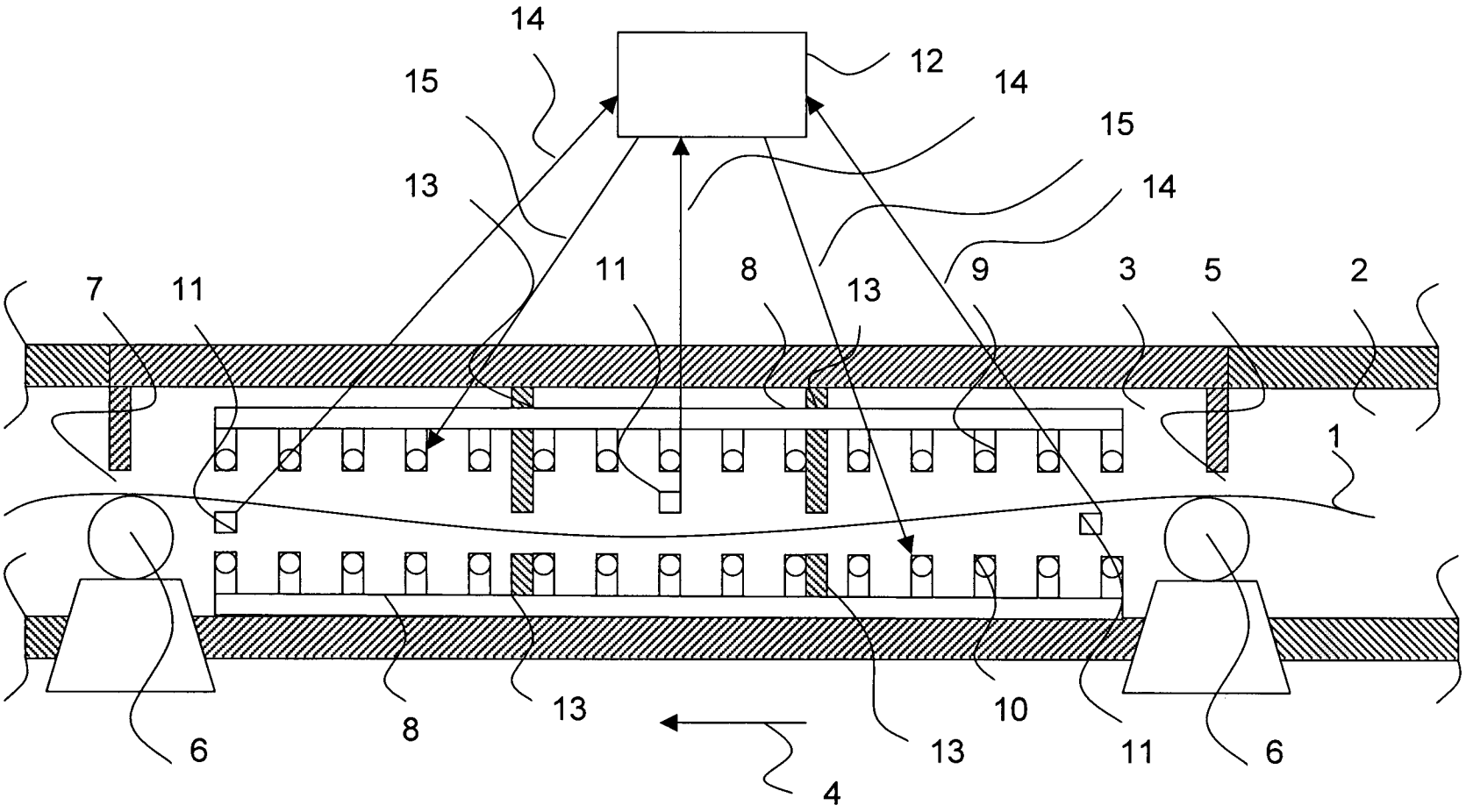
1
2
3
4
5
6
7
8
9
10
11
12
13
14
15

METHOD FOR CONTROLLING A METAL STRIP IN A HEAT TREATMENT FURNACE

This is a national stage application filed under 35 USC 371 based on International Application No. PCT/FI2007/000144 filed May 29, 2007, and claims priority under 35 USC 119 of Finnish Patent Application No. 20060536 filed Jun. 1, 2006.

The present invention relates to a method for controlling a metal strip to be heat-treated, contained in a continuously operated heat treatment furnace, which metal strip should be heat-treated, so that the metal strip can be conducted in a zone located between elements meant for supporting the metal strip without getting into contact with the furnace structures.

Cold rolled metal strip, such as strip made of stainless steel, is after the cold rolling subjected to annealing at a high temperature, within the temperature range 900-1150° C., so that recrystallization takes place in the strip microstructure, and the strip becomes easier to work with respect to further treatment. In the annealing step, on the surface of the strip there is formed an oxide layer that must be removed. The removal of the oxide layer is advantageously carried out by pickling, for instance in an aqueous solution made of nitric acid and hydrofluoric acid. The pickling process is carried out in conditions essentially corresponding to room temperature, and therefore the metal strip annealed at a high temperature must be cooled prior to the pickling treatment.

For cooling the strip, the cooling section of the heat treatment furnace includes cooling equipment, such as cooling pipes, provided in the cooling part of the furnaces and arranged on both sides of the strip in the proceeding direction thereof and essentially near the strip in order to achieve a sufficient cooling power; through nozzles installed in said cooling pipes, the cooling agent, such as air, is fed on the strip surface. In case the metal strip to be cooled gets into a mechanical contact with the cooling equipment, the treated metal strip is scratched, which results in losses affecting the metal strip quality and the production quantity.

The object of the present invention is to eliminate drawbacks of the prior art and to achieve a new and improved method for controlling a metal strip to be head-treated in a continuously operated heat treatment furnace, in a zone located between elements meant for supporting the metal strip, so that a mechanical contact between the metal strip and the furnace structures can be eliminated, particularly in connection with the cooling step after the heat treatment of the metal strip.

According to the invention, a metal strip to be heat-treated in a continuously operated heat treatment furnace, for instance a metal strip made of stainless steel, is conveyed at an essentially high speed to cooling after a heat treatment, such as annealing, in which cooling step the essentially horizontally proceeding and suspended metal strip is subjected to the treatment of controlled cooling agent jets, so that the metal strip trajectory, at least in the zone located between elements meant for supporting the metal strip, is made to proceed in between devices for conveying the cooling agent that are installed around the trajectory. In order to realize a controlled cooling agent jet, the metal strip trajectory is measured by a measuring device at least in the lengthwise direction of the metal strip, or at least in the width direction of the metal strip, preferably essentially continuously.

In a continuously operated heat treatment furnace, the metal strip to be heat-treated forms in the zone located between the elements meant for supporting the metal strip a sagging essentially having the shape of a funicular curve, so that the metal strip is in its lowest position in the middle of the zone provided between the elements for supporting the metal strip. In connection with the cooling process, the sagging with the funicular curve shape is, owing to heat contraction as opposite to heat expansion caused by the temperature difference, changed so that the position of the lowest point of the metal strip, in the zone located between the elements meant for supporting said metal strip, deviates from the zone center. Further, because a large quantity of cooling agent is needed for cooling the metal strip, especially a change in the flow resistance in the cooling agent inlet and outlet channel system causes fluctuations in the nozzle pressures on both sides of the metal strip, which at the same time means that the position of the metal strip is changed.

According to the invention, in a continuously operated heat treatment furnace the cooling of the metal strip to be heat-treated is carried out in at least one cooling zone arranged between elements meant for supporting the metal strip, said zone comprising devices for conveying the cooling agent, which devices are spaced apart at essentially equal distances both underneath and above the metal strip that is proceeding essentially horizontally. The device meant for conveying the cooling agent is provided with at least one nozzle, which is directed so that the emitted cooling agent is directed towards the metal strip surface moving past the nozzle. Now, in addition to the cooling effect, the trajectory of the metal strip can be changed when necessary, so that a possible mechanical contact with the equipment provided for conveying the cooling agent can be avoided. The cooling zone between the elements meant for supporting the metal strip is advantageously divided into at least two cooling blocks, for example by separating, by means of a partition wall, the devices meant for conveying the cooling agent, so that the cooling agent flowing through the nozzle from one block is prevented from flowing to the area of another cooling block.

The proceeding of the metal strip to be cooled in a cooling zone provided between the elements meant for supporting the metal strip is measured by means of at least one measuring device, preferably both in the lengthwise direction of the metal strip and in the width direction thereof. The measurement signals measured by the measuring device are transferred electrically to an automation unit, where the metal strip location results indicated by the measurement signals are compared with desired, predetermined location values. When necessary, the automation unit manages in a controlled fashion the actuators provided in the devices meant for conveying the cooling agent for obtaining a desired sagging in the metal strip.

According to the invention, the proceeding of the metal strip to be cooled to the devices meant for conveying the cooling agent and arranged both above and underneath the metal strip trajectory is prevented by changing, on the basis of the measurement signals received by the automation unit, the nozzle pressure of the cooling agent emitted from the nozzles; as a consequence, the force of the emitted cooling agent that supports or presses the metal strip down is changed, and the position of the metal strip sagging is obtained to be advantageous with respect to the devices meant for conveying the cooling agent.

According to the invention, the employed cooling agent is advantageously air, but the cooling agent can also be for example an inert gas, such as nitrogen or argon, or a gas mixture where the oxygen content is smaller than the oxygen content of air. Further, the employed cooling agent can be a liquid, such as water, and also a mixture of gas and liquid.

The invention is described in more detail below, with reference to the appended drawing, where FIG. 1 is a side-view illustration of a preferred embodiment of the invention, seen schematically in a partial cross-section.

According to FIG. 1, a hot, annealed strip 1 made of stainless steel enters from the annealing step 2 to the cooling zone 3, in which case the essentially horizontal proceeding direction of the strip 1 is illustrated by the reference number 4. In the proceeding direction 4 of the strip, at the outlet 5 of the annealing zone 2 and simultaneously at the inlet 5 of the cooling zone 3, there is installed a roller arrangement 6 supporting the strip 1. A corresponding roller arrangement for 6 supporting the strip 1 is installed in the proceeding direction 4 of the strip at the outlet 7 of the cooling zone 3. In between the roller arrangements 6, the strip 1 is in a suspended position.

In the cooling zone 3, in the proceeding direction 4 of the strip, above the strip 1 and underneath the strip 1 there are installed cooling agent pipes 8 for conveying the cooling agent 7 to the vicinity of the strip 1, and that end 9 of said pipes 8 that is located nearest to the strip 1 is provided with at least one nozzle 10 for directing the cooling agent 7 onto the surface of the strip 1.

The position of the strip 1 located between the roller arrangements 6 both in the width direction of the strip 1 and in the lengthwise direction of the strip 1 is measured by at least one measuring device 11, preferably a laser measuring device. The measurement signal obtained from the measuring device 11 is fed to an automation unit 12 that is electrically 14 connected to the measuring device 11. In addition, the automation unit 12 is advantageously connected electrically 15, either separately or in a group, to every nozzle 10 provided in the cooling agent pipes 8 in order to control the nozzles for achieving the desired position value for the strip 1 at various points of the cooling zone 3. For the sake of simplicity, only two nozzles are illustrated in the drawing as regards the electrical connecting 15 of the nozzles 10. The figure also shows partition walls 13 that divide the cooling zone into cooling blocks.

In the automation unit 12, the obtained measurement signal value is compared with the desired position value of the strip 1 with respect to the cooling agent pipes 8. In case the measured value deviates from the desired position value of the strip 1, a control signal is sent from the automation unit 12 to at least one cooling agent pipe nozzle 10 for correcting the position value of the strip 1 essentially at that point of the cooling zone 3 where the measurement signal deviating from the desired position value was sent from. The control signal for changing the position value of the strip 1 adjusts the adjusting device provided in connection with the nozzle 10, which device changes the pressure of air emitted through the nozzle 10 with respect to the strip 1.

The invention claimed is:

1. A method for carrying out a heat treatment operation on a metal strip, comprising:

continuously feeding the metal strip lengthwise in an essentially horizontal direction through a cooling zone so that the metal strip extends through the cooling zone, supporting the strip extending through the cooling zone at first and second support locations that are at substantially equal vertical heights and are spaced apart horizontally, positioning the strip so that it avoids mechanical contact from anything other than the support locations, and the strip is suspended between the first and second support locations and follows a trajectory between the first and second support locations, the first support location being upstream of the cooling zone relative to feeding movement of the metal strip and the second support location being downstream of the cooling zone relative to feeding movement of the metal strip, dividing the cooling zone into at least an upstream block and a downstream block with at least one partition wall, employing a first device to project at least a first jet of a cooling agent towards the metal strip in the upstream block of the cooling zone, employing a second device to project at least a second jet of a cooling agent towards the metal strip in the downstream block of the cooling zone, preventing, by use the at least one partition wall, the cooling agent projected from the first device in the upstream block from flowing to the area of the downstream block, measuring a value for a position and sagging of the metal strip between the first and second support locations, comparing the measured value of the metal strip with a predetermined desired position and sagging value, controlling at least one of the cooling agent jets in response to the comparison, and changing the position and sagging of the metal strip by changing a force of an emitted cooling agent from at least one of the cooling jets aimed toward and supporting metal strip, wherein the first device, the second device, or both, are installed around the trajectory of the metal strip.

2. A method according to claim 1, wherein the cooling agent of the first and second jets is air.

* * * * *